US011815840B2

(12) United States Patent
Daimon et al.

(10) Patent No.: US 11,815,840 B2
(45) Date of Patent: Nov. 14, 2023

(54) PRINTER WITH HOUSING FOR ROLLED PAPER

(71) Applicants: CITIZEN WATCH CO., LTD., Nishitokyo (JP); CITIZEN SYSTEMS JAPAN CO., LTD., Nishitokyo (JP)

(72) Inventors: Kohei Daimon, Saitama (JP); Takeo Komiyama, Higashikurume (JP); Hiroyuki Yasuda, Kawasaki (JP); Katsunori Shimizu, Kodaira (JP)

(73) Assignees: Citizen Watch Co., Ltd., Nishitokyo (JP); Citizen Systems Japan Co., Ltd., Nishitokyo (JP)

( * ) Notice: Subject to any disclaimer, the term of this patent is extended or adjusted under 35 U.S.C. 154(b) by 0 days.

(21) Appl. No.: 17/691,605

(22) Filed: Mar. 10, 2022

(65) Prior Publication Data

US 2022/0299930 A1 Sep. 22, 2022

(30) Foreign Application Priority Data

Mar. 17, 2021 (JP) ..... 2021-043954

(51) Int. Cl.
*G03G 15/00* (2006.01)
*B41J 15/00* (2006.01)
(Continued)

(52) U.S. Cl.
CPC ..... *G03G 15/6517* (2013.01); *B41J 15/042* (2013.01); *B65H 16/02* (2013.01);
(Continued)

(58) Field of Classification Search
CPC ..... G03G 15/6517; G03G 2215/00455; B41J 15/04; B41J 15/042; B41J 15/044;
(Continued)

(56) References Cited

U.S. PATENT DOCUMENTS 10,457,515 B2 * 10/2019 Hagi ..... B41J 11/0005
2001/0014242 A1 8/2001 Yamada
(Continued)

FOREIGN PATENT DOCUMENTS

JP 58-22245 A * 2/1983
JP 2000211777 A 8/2000
(Continued)

OTHER PUBLICATIONS

Japanese Office Action for Application No. 2021-043954, dated Aug. 17, 2022 in 4 pages.

*Primary Examiner* — Robert B Beatty
(74) *Attorney, Agent, or Firm* — Knobbe Martens Olson & Bear LLP

(57) ABSTRACT

A printer includes a case including an input port for rolled paper, a cover provided to be rotatable between a closed position of the input port and an open position of the input port, a holding portion that holds the rolled paper, a biasing member that biases the holding portion in a first direction, a stopper mechanism that stops rotation of the holding portion in the first direction, and a linkage mechanism that rotates the holding portion in conjunction with the rotation of the cover. When the cover is in the closed position, the holding portion rotates in the first direction in accordance with an outer diameter of the rolled paper by a biasing force of the biasing member. When the cover rotates from the closed position to the open position, the holding portion rotates together with the cover against the biasing force of the biasing member.

7 Claims, 12 Drawing Sheets

(51) Int. Cl.

| | |
|---|---|
| ***B65H 16/00*** | (2006.01) |
| ***B41J 15/04*** | (2006.01) |
| ***B65H 16/02*** | (2006.01) |
| ***B65H 23/08*** | (2006.01) |
| *G03G 21/16* | (2006.01) |

(52) U.S. Cl.
CPC ..... *B65H 23/08* (2013.01); *B65H 2405/42* (2013.01); *B65H 2801/03* (2013.01); *G03G 21/1633* (2013.01); *G03G 2215/00455* (2013.01)

(58) Field of Classification Search
CPC ..... B65H 16/02; B65H 16/06; B65H 23/08; B65H 23/085; B65H 2405/42; B65H 2405/421
USPC ..... 399/384
See application file for complete search history.

(56) References Cited

U.S. PATENT DOCUMENTS

| | | | | |
|---|---|---|---|---|
| 2016/0176209 | A1* | 6/2016 | Ishimori | B41J 15/042 347/104 |
| 2017/0072717 | A1* | 3/2017 | Yada | B41J 29/02 |
| 2017/0120644 | A1* | 5/2017 | Oguchi | B41J 11/04 |
| 2018/0104967 | A1* | 4/2018 | Yada | B41J 15/04 |
| 2021/0060987 | A1* | 3/2021 | Tokuda | B41J 3/36 |

FOREIGN PATENT DOCUMENTS

| | | | |
|---|---|---|---|
| JP | 3767290 | B2 | 2/2006 |
| KR | 20160078869 | A * | 7/2016 |

* cited by examiner

PRINTER WITH HOUSING FOR ROLLED PAPER

CROSS-REFERENCE TO RELATED APPLICATION

The present application is based on and claims priority from Japanese patent application No. 2021-043954 filed on Mar. 17, 2021, the disclosure of which is hereby incorporated by reference in its entirety.

TECHNICAL FIELD

A present disclosure relates to a printer including a housing that houses rolled paper.

BACKGROUND

A printer using rolled paper is conventionally known as taught in JP3767290B, for example. Such a printer is provided with a housing that houses the rolled paper.

JP3767290B discloses a positioning movable plate that rotates in conjunction with rotation of a holder cover when the holder cover is closed after the rolled paper is inserted in a rolled paper holder, and is locked at a position where a second positioning groove should be formed. The second positioning groove is formed between the positioning movable plate and a second bottom inclined plane. When the holder cover is closed, the positioning movable plate pushes the rolled paper deeply into the rolled paper holder while rotating to be locked with that state. The rolled paper is thereby held between the positioning movable plate and an inclined holding portion of the second bottom. When the holder cover is open, the positioning movable plate is arranged in the back side of the holder cover. Accordingly, the positioning movable plate does not disturb the rolled paper from being housed in the rolled paper holder.

SUMMARY

In the printer using the rolled paper, inertia acts on the rolled paper when a sheet is fed from the rolled paper. In order to control such inertia acting on the rolled paper, a mechanism that holds the rolled paper is required. In the configuration described in JP3767290B, the rolled paper is held between the positioning movable plate and the inclined holding portion of the second bottom. For this reason, in the configuration of JP3767290B, as the inertia strongly acts on the rolled paper depending on a drawing force when the sheet is fed, the housed rolled paper cannot be maintained in a desired position.

It is therefore an object of the present disclosure to provide a printer in which housed rolled paper is maintained in a desired position, and rolled paper is easily exchanged.

To achieve the above object, the printer of the present disclosure includes a case including an input port from which rolled paper is put into a housing that houses the rolled paper, a cover provided to be rotatable between a closed position that closes the input port and an open position that opens the input port, a holding portion that is rotatably attached to the case, extends toward the input port, and holds the rolled paper, a biasing member that biases the holding portion in a first direction toward the rolled paper housed in the housing, a stopper mechanism that stops rotation of the holding portion in the first direction, and a linkage mechanism that rotates the holding portion in conjunction with the rotation of the cover when the cover rotates from the closed position to the open position, wherein when the cover is in the closed position, the holding portion rotates in the first direction in accordance with an outer diameter of the rolled paper by a biasing force of the biasing member, and when the cover rotates from the closed position to the open position, the holding portion rotates together with the cover against the biasing force of the biasing member.

It is to be understood that the general description above and the detailed description in the following are merely illustrative and do not limit the present disclosure.

The accompanying drawings herein, which are incorporated in and constitute a part of this specification, illustrate embodiments consistent with the present disclosure and, together with the specification, serve to explain principles of the present disclosure.

DETAILED DESCRIPTION

With respect to the use of plural and/or singular terms herein, those having skill in the art can translate from the plural to the singular and/or from the singular to the plural as is appropriate to the context and/or application. The various singular/plural permutations may be expressly set forth herein for sake of clarity.

Hereinafter, an embodiment of a printer according to the present disclosure will be described with reference to a first embodiment.

The printer of the first embodiment is applied to a thermal printer that performs thermal print.

Figure 1:
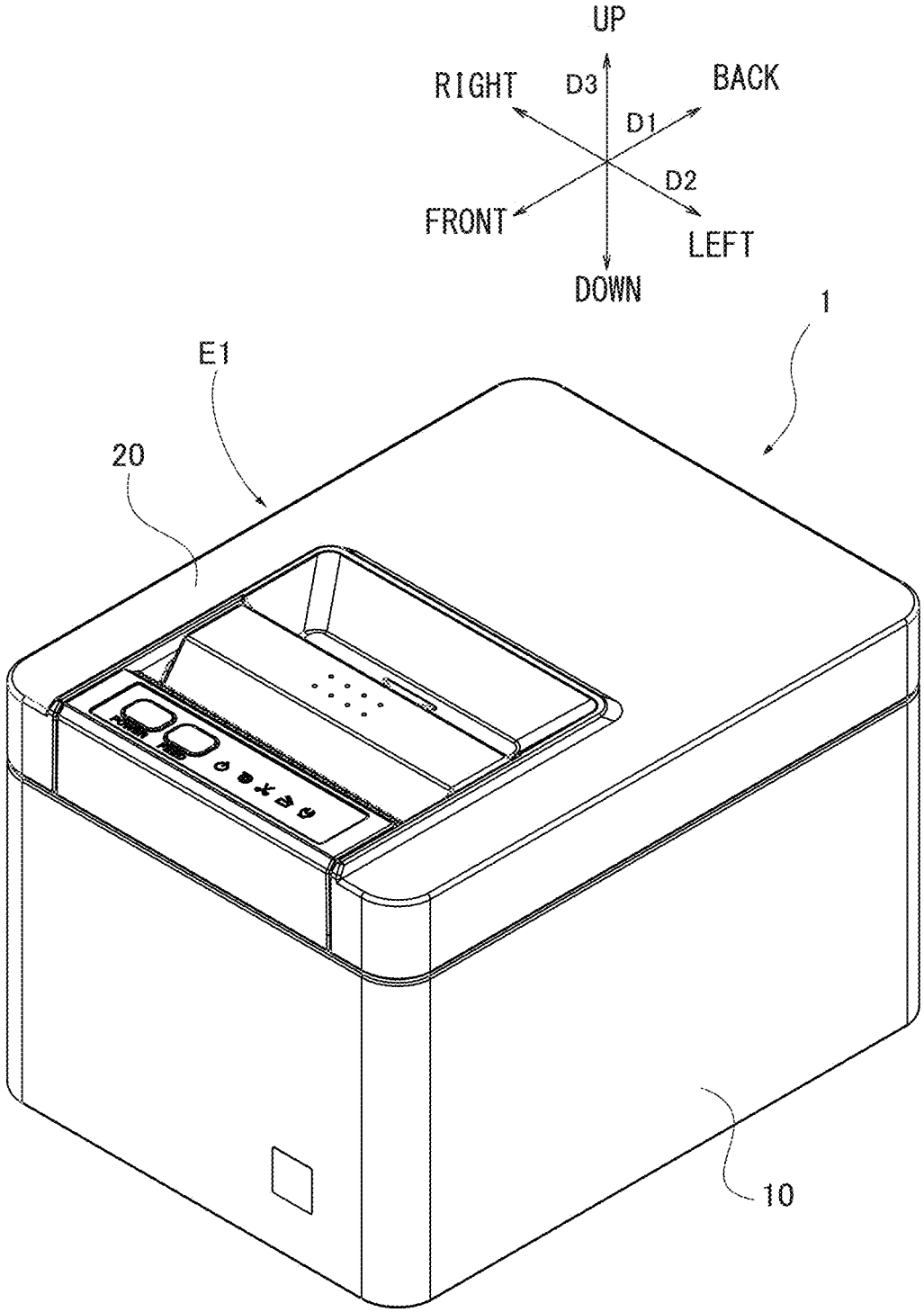
FIG. 1 is a perspective view illustrating a printer of a first embodiment in which a cover is closed.
Figure 2:
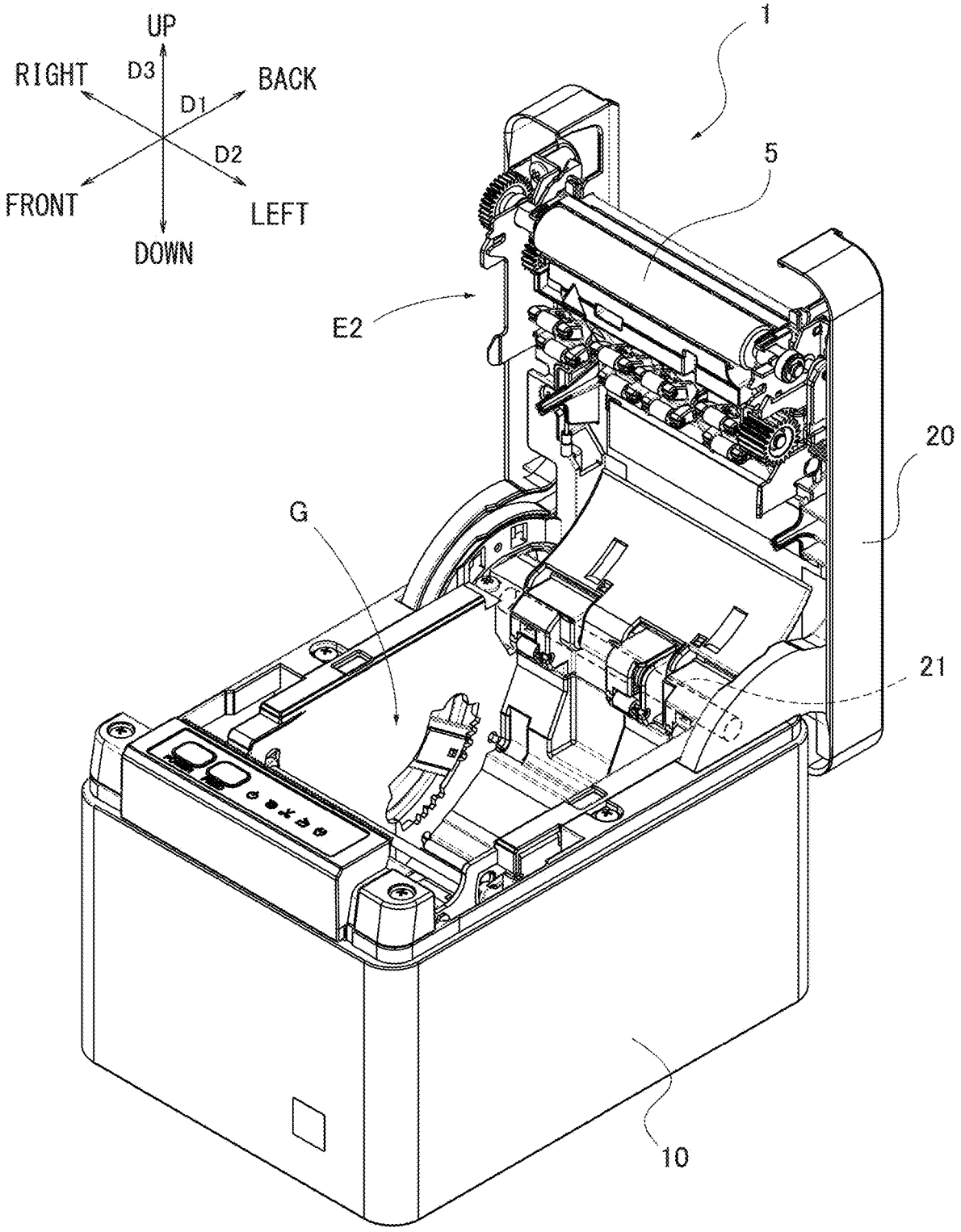
FIG. 2 is a perspective view illustrating the printer of the first embodiment in which the cover is open.
Figure 3:
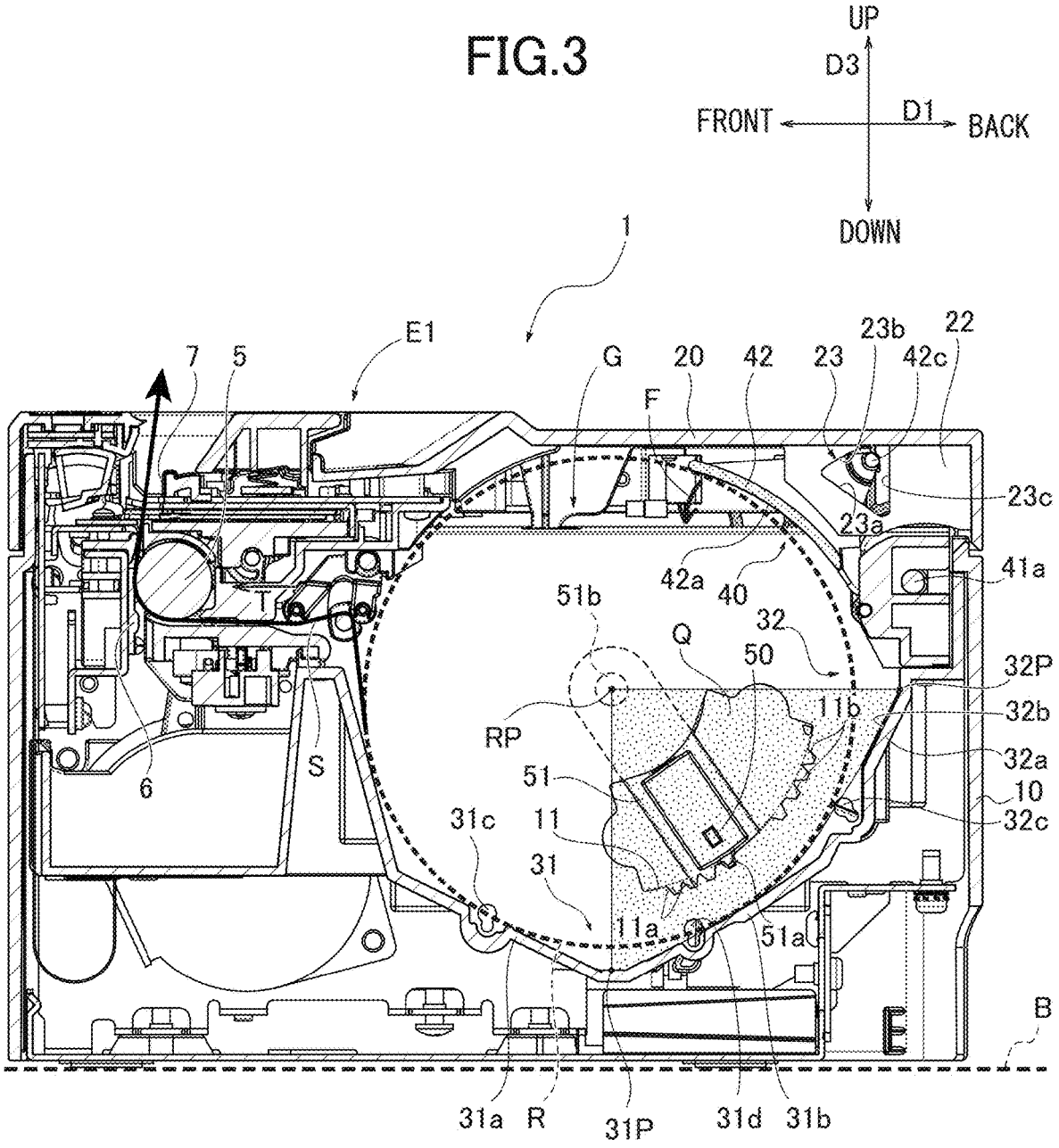
FIG. 3 is a sectional view illustrating the printer of the first embodiment in which the cover is closed.

A configuration of the printer will be described. FIG. 1 is a perspective view illustrating the printer of the first embodiment in which a cover is in a closed position. FIG. 2 is a perspective view illustrating the printer of the first embodiment in which the cover is in an open position. FIG. 3 is a sectional view illustrating the printer of the first embodiment in which the cover is in the closed position. Hereinafter, the configuration of the printer of the first embodiment will be described.

Note that a front-back direction of the printer 1 is a front-back direction D1, a right-left direction of the printer 1 is a width direction D2, and an up and down direction of the printer 1 is a vertical direction D3.

As illustrated in FIG. 1, the printer 1 includes a case 10 and a cover 20.

As illustrated in FIG. 2, the case 10 is a rectangular box having on the top thereof an opening portion. The opening portion of the case 10 configures an input port G from which rolled paper R is put (taken in and taken out) into a housing that houses the rolled paper R.

The cover 20 is provided to be rotatable about a rotation axis 21 between a closed position E1 (refer to FIG. 1) where the input port G is closed and an open position E2 (refer to FIG. 2) where the input port G is open. The rotation axis 21 extends in the width direction D2. The rolled paper R is a rolled long sheet S.

As illustrated in FIG. 3, the case 10 includes inside thereof a thermal head unit 6, a first housing 31 and a second housing 32 as housings that house the rolled paper R, a holding member 40 that holds the rolled paper R, and a rolled paper remaining detection sensor 50 that detects the remaining of the rolled paper R.

A platen roller 5 is attached to the rear side of the cover 20. The platen roller 5 is attached to the cover 20 to face the thermal head unit 6 when the cover 20 is in the closed position E1. The thermal head unit 6 performs thermal print onto the sheet S when the thermal head unit 6 is biased in a direction in which the thermal head unit 6 contacts the platen roller 5.

The printer 1 configured as described above feeds the sheet S from the rolled paper R when the platen roller 5 rotates. The sheet S fed from the rolled paper R is fed in a feeding direction T, is thermally printed by the thermal head unit 6, and is discharged from a discharge port 7.

A configuration of the first housing will be described. As illustrated in FIG. 3, the first housing 31 is provided at the bottom of the case 10. The first housing 31 houses the rolled paper R when the case 10 is put on an installation base B in a horizontal posture such that the cover 20 in the closed position E1 is the top face.

The first housing 31 includes a first inclined holding portion 31*a* and a second inclined holding portion 31*b* to form a sectional V shape having on the top thereof an opening portion. The first inclined holding portion 31*a* and the second inclined holding portion 31*b* hold the outer circumferential surface of the rolled paper R from below.

The first inclined holding portion 31*a* and the second inclined holding portion 31*b* may include holding rollers 31*c*, 31*d* that rotatably hold the rolled paper R.

The rolled paper R is housed in the first housing 31 configured as described above such that the sheet S is fed from the lower side of the rolled paper R when the case 10 is horizontally put. Namely, the sheet S is fed from the rolled paper R on the side opposite to the side provided with a holding portion 42.

Figure 8:
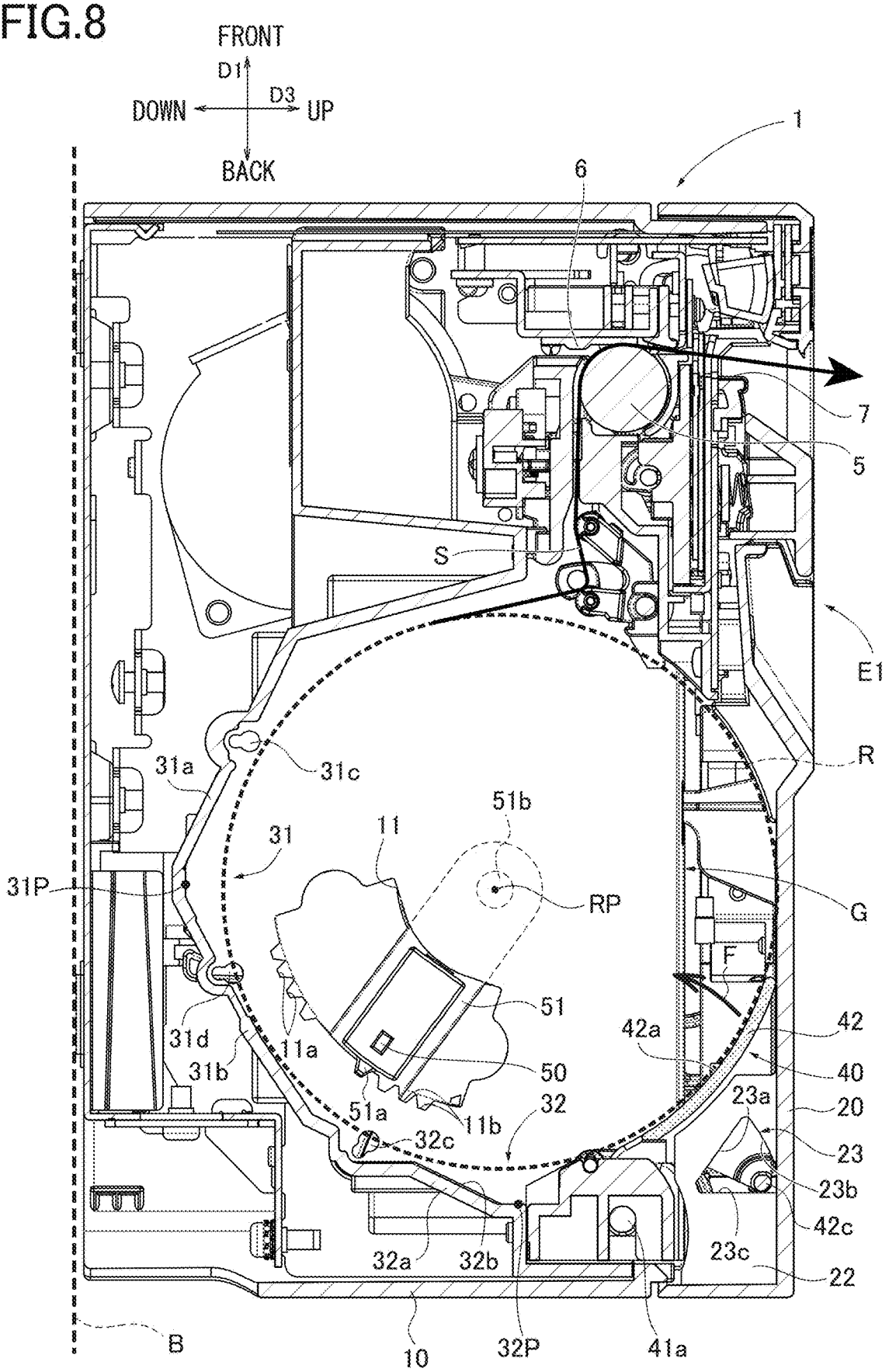
FIG. 8 is a sectional view illustrating the printer of the first embodiment in which rolled paper having a maximum diameter is housed in a second housing.

A configuration of the second housing will be described. As illustrated in FIG. 3, a second housing 32 is provided in a side portion of a back side of the case 10. As illustrated in FIG. 8, the second housing 32 houses the rolled paper R when the case 10 is put on the installation base B in a vertical posture such that the cover 20 in the closed position E1 is the side face.

The second housing 32 has an upper-opened sectional V shape with an inclined holding portion 32*a* and the holding portion 42 of the holding member 40. The holding portion 42 extends toward the input port G to close a part of the input port G.

The inclined holding portion 32*a* is provided to be closer to the bottom of the case 10 than the holding portion 42. The surface of the inclined holding portion 32*a* configures a holding face 32*b* of the inclined holding portion 32*a*. The inclined holding portion 32*a* and the holding portion 42 hold the outer circumference surface of the rolled paper R from below.

The position where the rolled paper R having the maximum diameter is housed in the second housing 32 when the case 10 is put in the vertical posture is substantially the same as the position where the rolled paper R having the maximum diameter is housed in the first housing 31 when the case 10 is put in the horizontal posture.

The inclined holding portion 32*a* may include a holding roller 32*c* that rotatably holds the rolled paper R.

The rolled paper R is housed in the second housing 32 configured as described above such that the sheet S is fed from the left side of the rolled paper R. Namely, the sheet S is fed from the rolled paper R on the side opposite to the side provided with the holding portion 42.

Figure 4:
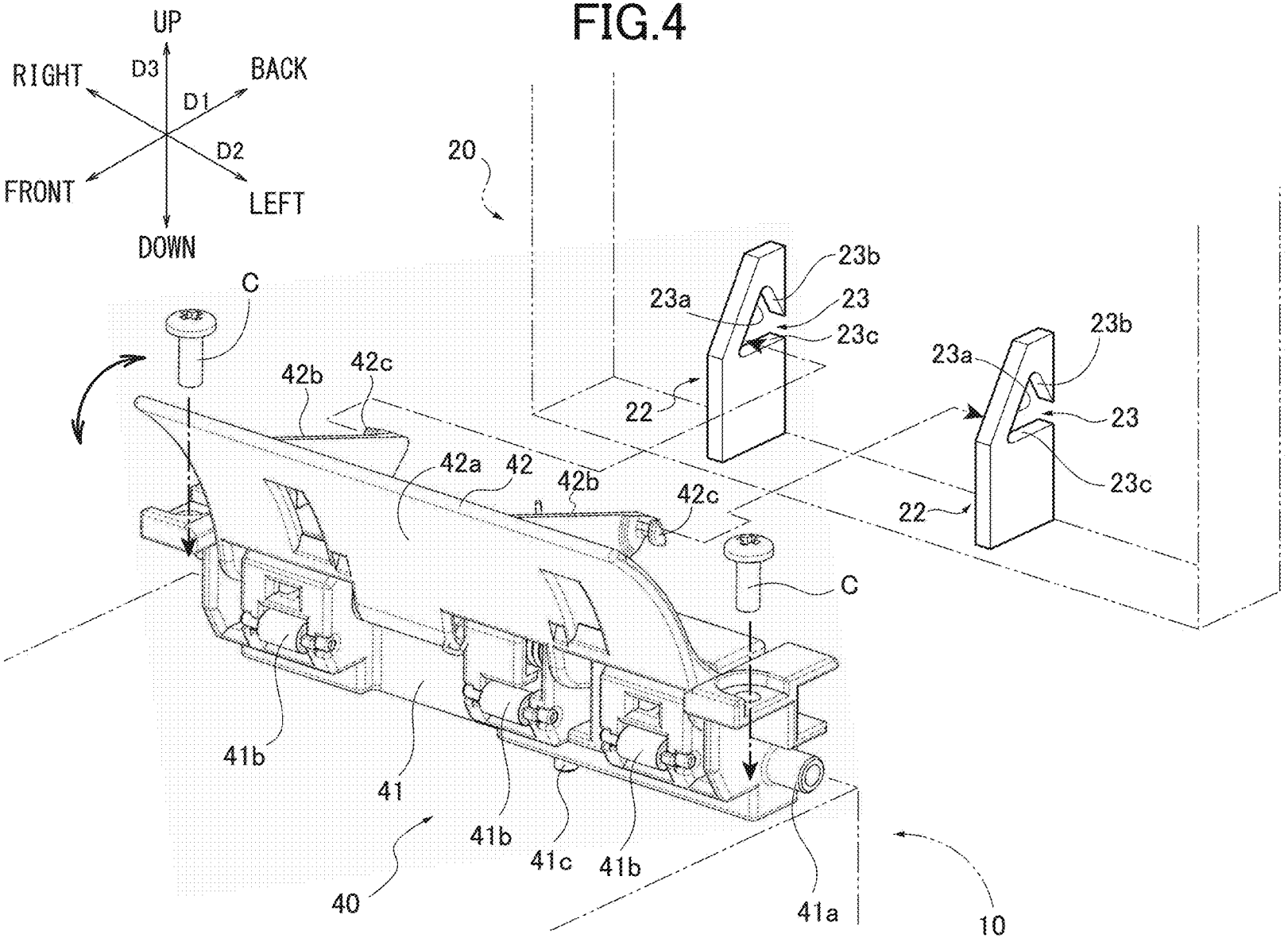
FIG. 4 is an exploded perspective view illustrating a peripheral of a holding member of the first embodiment.
Figure 5:
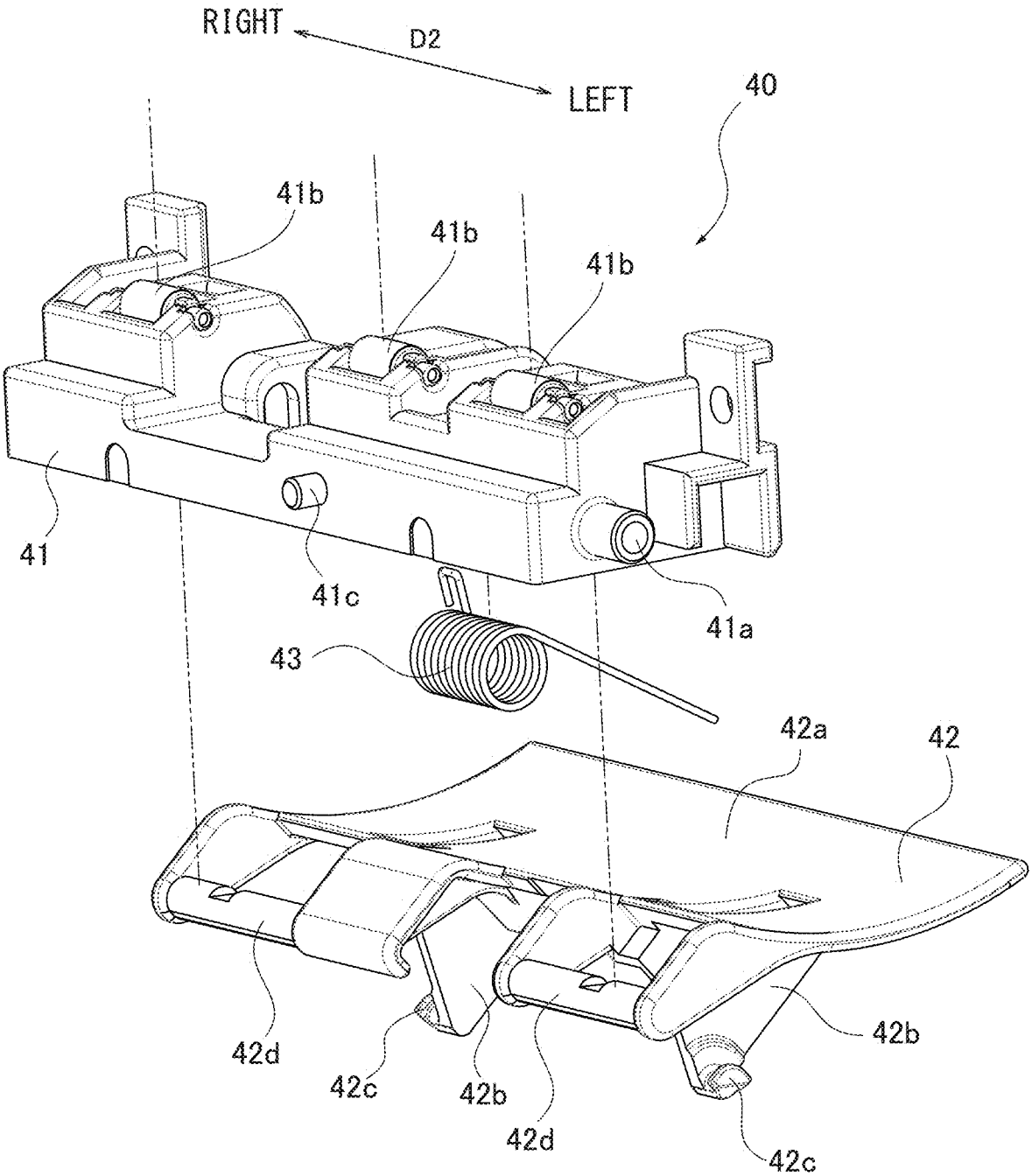
FIG. 5 is an exploded perspective view illustrating the holding member of the first embodiment.
Figure 6:
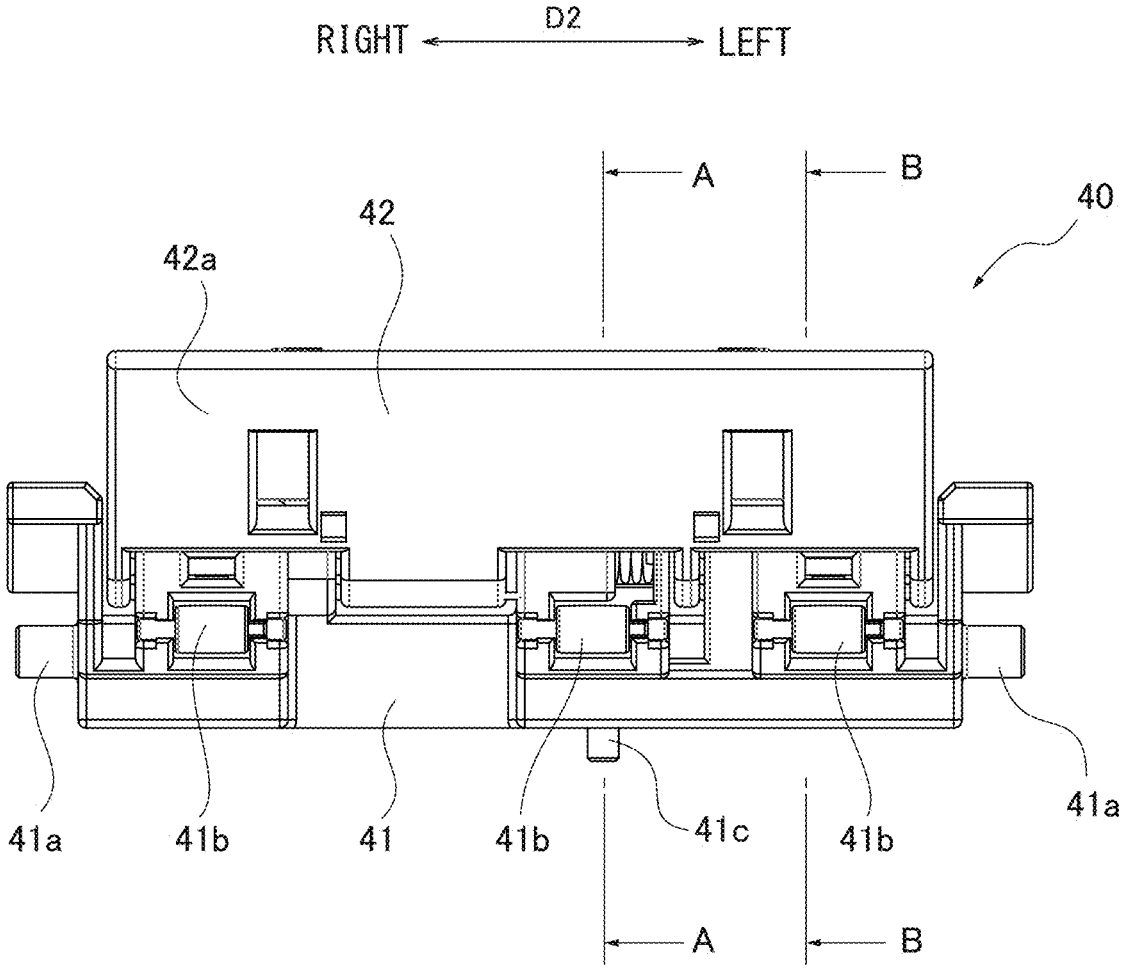
FIG. 6 is a plan view illustrating the holding member of the first embodiment.
Figure 7A:
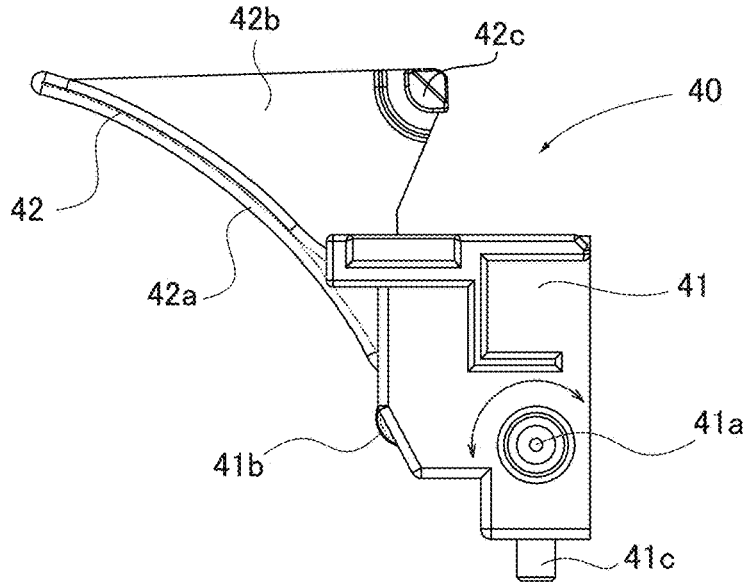
FIG. 7A is a side view illustrating the holding member of the first embodiment.
Figure 7B:
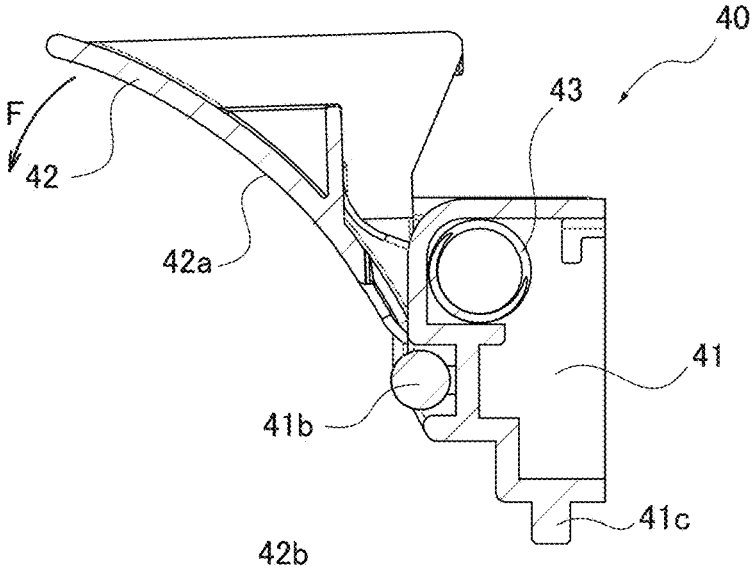
FIG. 7B is a sectional view along an AA section of FIG. 6.
Figure 7C:
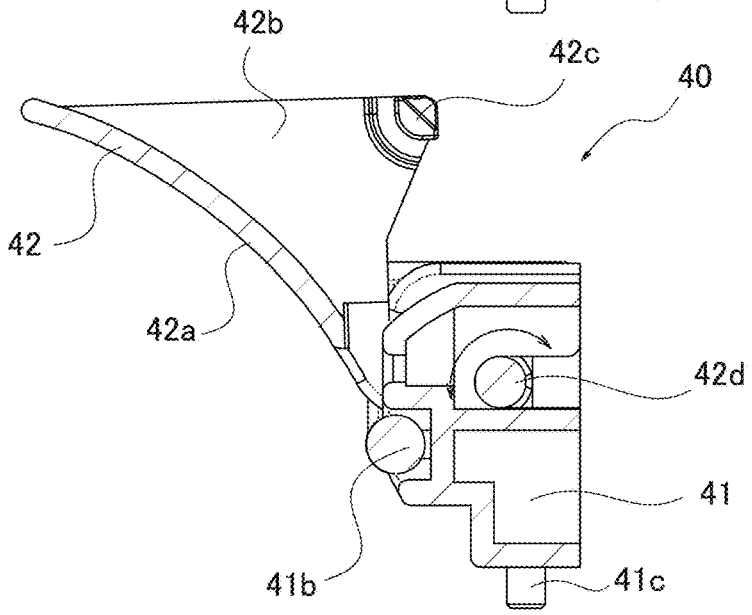
FIG. 7C is a sectional view along a BB section of FIG. 6.

A configuration of the holding member will be described. FIG. 4 is an exploded perspective view illustrating the peripheral of the holding member 40 of the first embodiment. FIG. 5 is an exploded perspective view illustrating the holding member 40 of the first embodiment. FIG. 6 is a plan view illustrating the holding member 40 of the first embodiment. FIG. 7A is a side view illustrating the holding portion 42 of the holding member 40 of the first embodiment. FIG. 7B is a sectional view along the AA section of FIG. 6. FIG. 7C is a sectional view along the BB section of FIG. 6. Hereinafter, the configuration of the holding member 40 of the first embodiment will be described.

As illustrated in FIG. 3, the holding member 40 configures the second housing 32 together with the inclined holding portion 32*a*. As illustrated in FIGS. 4 and 5, the holding member 40 includes a holder 41 that is fixed to the case 10, the holding portion 42 that extends toward the input port G, and a biasing member 43 that biases the holding portion 42.

As illustrated in FIG. 6, the holder 41 is provided with a projection 41*a* and a holding roller 41*b*.

As illustrated in FIG. 4, a positioning boss 41*c* fits into the positioning hole provided in the case 10, and a screw C is inserted into a screw hole 44. The holder 41 is thereby screwed. The cylindrical projection 41*a* that projects outside the side face of the holder 41 in the width direction D2 operates as the rotation axis 21 of the cover 20.

The holding roller 41*b* rotatably holds the rolled paper R together with the holding roller 32*c*. The holding roller 41*b* and the holding roller 32*c* may be omitted.

As illustrated in FIGS. 4 and 5, the holding portion 42 includes a holding face 42*a* provided in the front face of the holding portion 42, a rib 42*b* provided in the rear face of the holding portion 42, a projection 42*c* provided in the rib 42*b*, and a rotation axis 42*d* provided in the lower end of the holding portion 42.

As illustrated in FIG. 3, the holding face 42*a* of the holding portion 42 and the holding face 32*b* of the second housing 32 form a sectional V shape. The holding face 42*a* may have a curved face or a flat face along the outer diameter of the rolled paper R having the maximum diameter.

As illustrated in FIG. 5, the two ribs 42*b* are provided in the rear face of the holding portion 42. The rib 42*b* extends in the thickness direction of the holding portion 42 from the rear face of the holding portion 42. The leading end of the rib 42*b* is provided with the projection 42*c* that projects outside in the width direction D2.

As illustrated in FIGS. 5 and 7C, the lower end of the holding portion 42 is provided with the rotation axis 42*d* that extends in the width direction D2. The holding portion 42 is supported by the holder 41 to be rotatable about the rotation axis 42*d*.

As illustrated in FIG. 5, the biasing member 43 may be a torsion spring. The biasing member 43 is provided between the holder 41 and the holding portion 42. As illustrated in FIGS. 3 and 7B, the biasing member 43 biases the holding portion 42 provided to be rotatable about the rotation axis 42*d* in a first direction F toward the rolled paper R housed in the first housing 31 or the second housing 32.

As illustrated in FIGS. 3 and 4, the projection 42*c* provided in the holding portion 42 is inserted into the opening portion 23 provided in the rib 22 attached to the cover 20. The opening portion 23 includes a first face 23*a*, a second face 23*b*, and a third face 23*c* to have an approximate triangle shape in the side view.

The first face 23*a* extends in the direction substantially orthogonal to the first direction F. The first face 23*a* is configured as a stopper that stops the projection 42*c* from moving in the first direction F. Namely, the first face 23*a* contacts the projection 42*c* attached to the holding portion 42 to stop the holding portion 42 from rotating in the first direction F.

The first face 23*a* as the stopper and the projection 42*c* configure a stopper mechanism that stops the holding portion 42 from rotating in the first direction F. The stopper mechanism controls the rotation of the holding portion 42 in the first direction F within a predetermined rotation range, and moves the engaged holding portion 42 and cover 20 together when the cover 20 rotates from the closed position E1 to the open position E2.

The first face 23*a* as the stopper and the projection 42*c* configure a linkage mechanism that moves the engaged cover 20 and holding portion 42 together. The linkage mechanism rotates the holding portion 42 in conjunction with the rotation of the cover 20 when the cover 20 rotates from the closed position E1 to the open position E2.

The second face 23*b* extends in the first direction F from one end of the first face 23*a*. The third face 23*c* connects the other end of the first face 23*a* and the end portion of the second face 23*b*.

A configuration of a rolled paper remaining detection sensor will be described. As illustrated in FIG. 3, the case 10 includes on the side wall face thereof a rolled paper remaining detection sensor (paper near end sensor) 50. The rolled paper remaining detection sensor 50 is a light reflection sensor that irradiates light to the side face of the rolled paper R through an opening portion 11 provided in the side wall face of the case 10, and receives the reflection light reflected by the side face of the rolled paper R.

The rolled paper remaining detection sensor 50 detects that the remaining of the rolled paper R reaches a set amount. More specifically, the rolled paper remaining detection sensor 50 detects the remaining of the rolled paper R based on the reflection light from the side face of the rolled paper R.

The rolled paper remaining detection sensor 50 is disposed in a region Q surrounded by a center axis RP of the rolled paper R having the maximum diameter, which is housed in the first housing 31 or the second housing 32, a first apex 31P that is an apex of the sectional V shape of the first housing 31, and a second apex 32P that is an apex of the sectional V shape of the second housing 32.

The rolled paper remaining detection sensor 50 is attached to an operation lever 51. The operation lever 51 is rotatable about a rotation axis 51*b* on the plane parallel to the side face of the rolled paper R housed in the first housing 31 or the second housing 32.

The rolled paper remaining detection sensor 50 is movable in a circular arc along the outer diameter of the rolled paper R having the maximum diameter, which is housed in the first housing 31 or the second housing 32. The opening portion 11 has an approximate fan shape to control the movement range of the operation lever 51.

The operation lever 51 is provided with a convex portion 51*a* projecting toward the leading end. The convex portion 51*a* fits into a first groove 11*a* and a second groove 11*b* provided in the opening portion 11.

For example, four first grooves 11*a* are provided in the opening portion 11 on the first housing 31 side. For example, four second grooves 11*b* are provided in the opening portion 11 on the second housing 32 side.

The convex portion 51*a* fits into the first groove 11*a* or the second groove 11*b*. The rolled paper remaining detection sensor 50 is thereby positioned. The convex portion 51*a* fits into the first groove 11*a*. The rolled paper remaining detection sensor 50 thereby detects the remaining of the rolled paper R housed in the first housing 31. The convex portion 51*a* fits into the second groove 11*b*. The rolled paper remaining detection sensor 50 thereby detects the remaining of the rolled paper R housed in the second housing 32.

Figure 9:
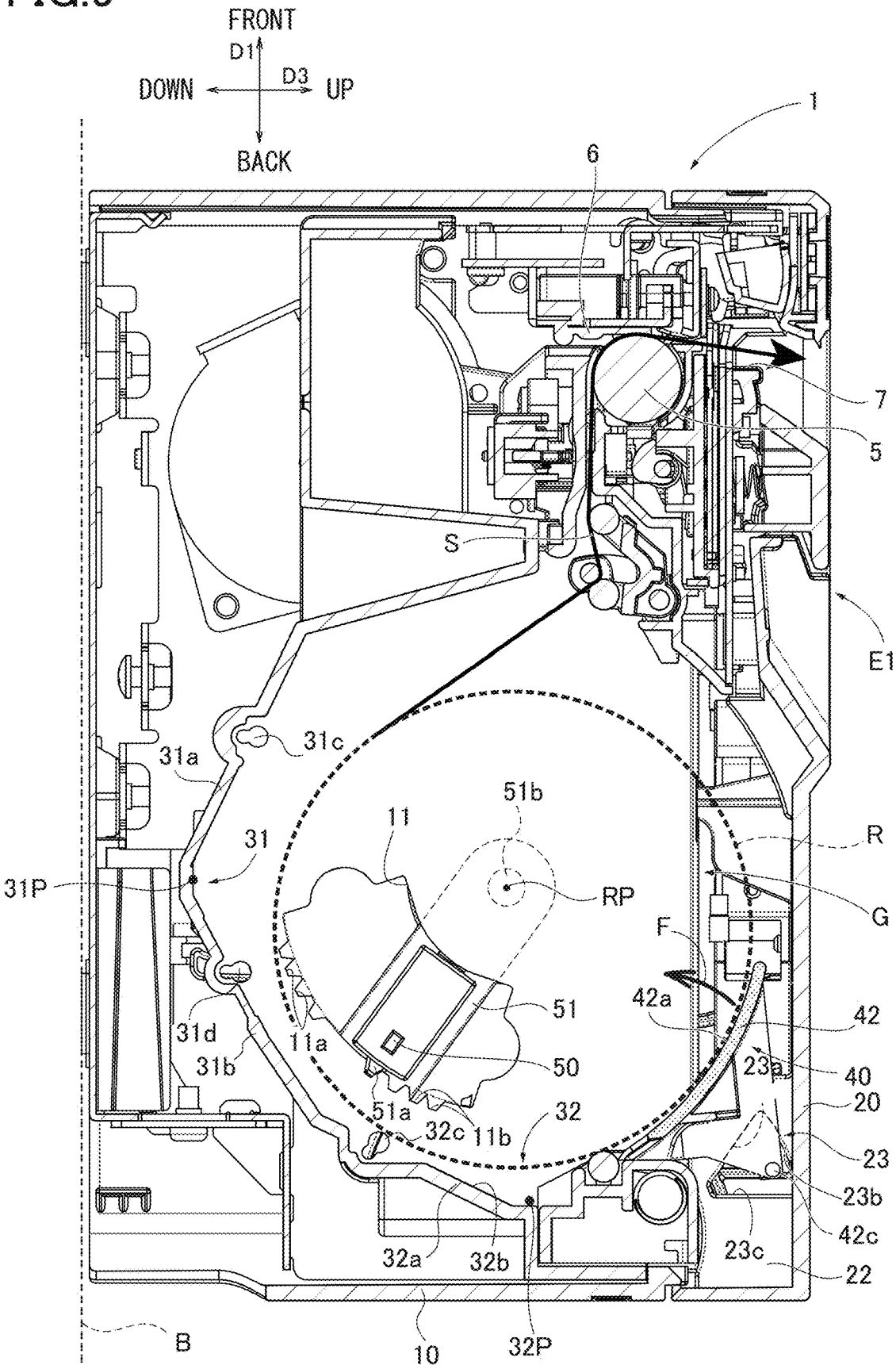
FIG. 9 is a sectional view illustrating the printer of the first embodiment in which rolled paper having a medium diameter is housed in the second housing.
Figure 10:
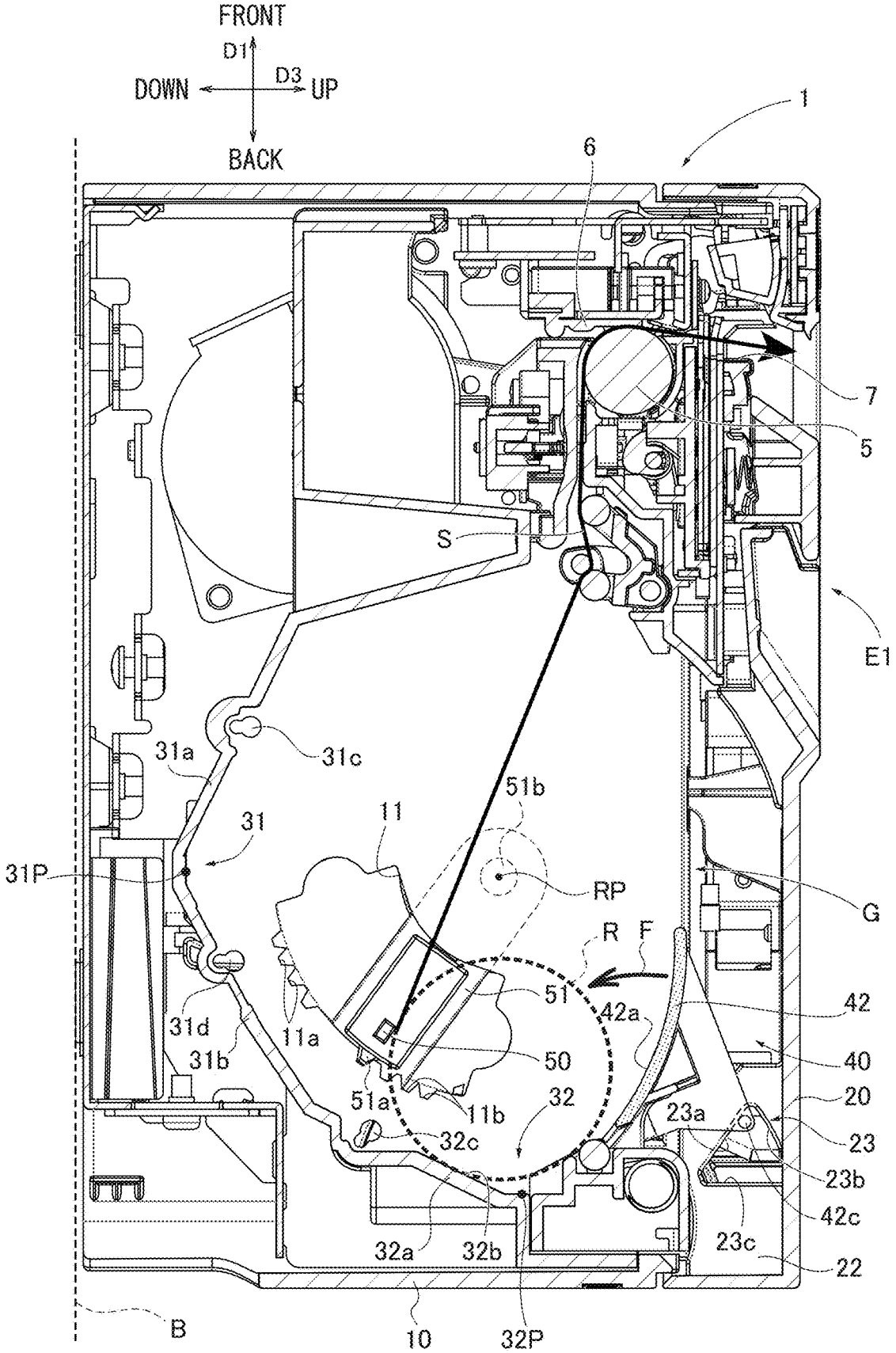
FIG. 10 is a sectional view illustrating the printer of the first embodiment in which rolled paper having a small diameter is housed in the second housing.
Figure 11:
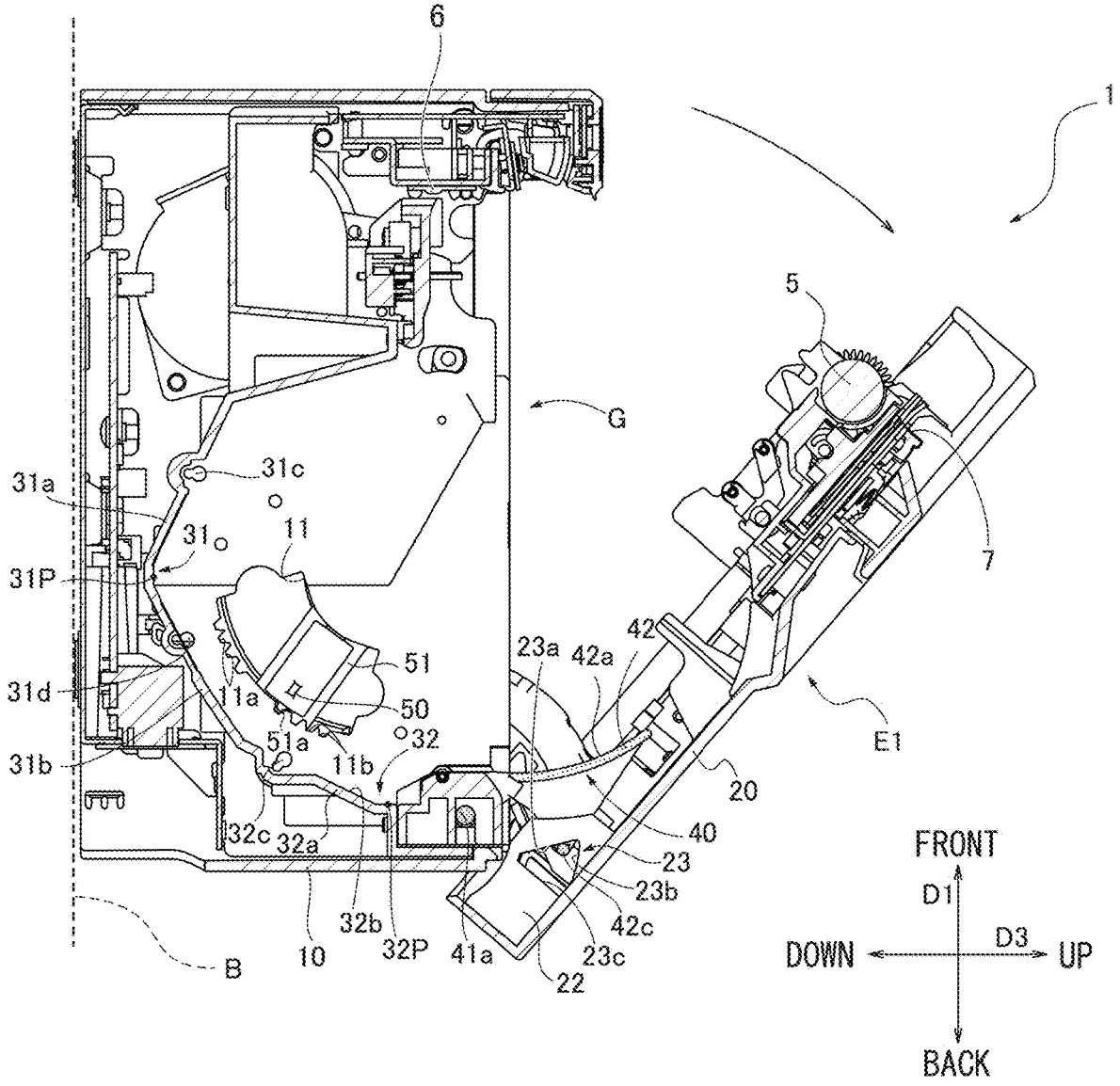
FIG. 11 is a sectional view illustrating the printer of the first embodiment in which the cover is moving from a closed position to an open position.
Figure 12:
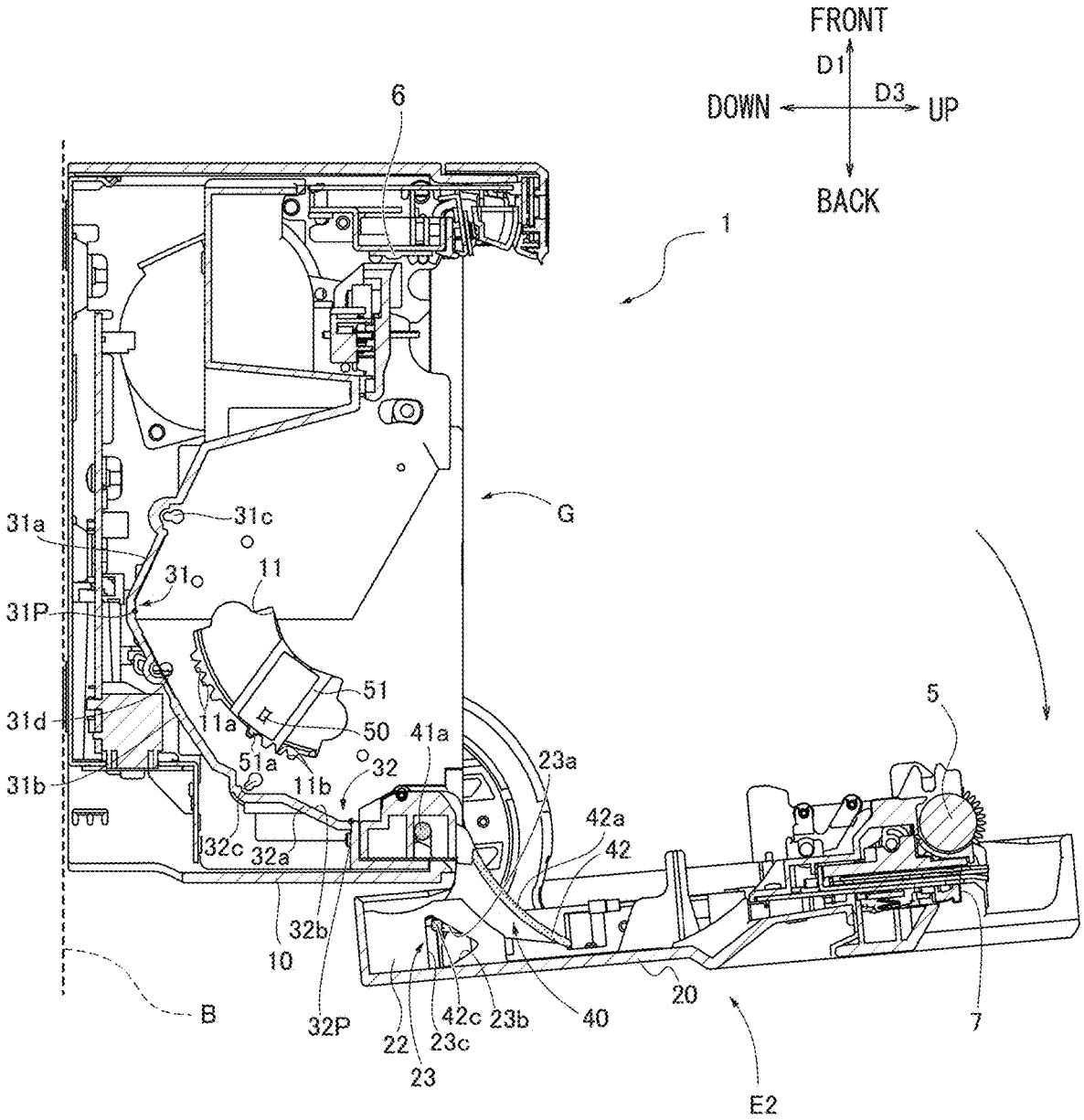
FIG. 12 is a sectional view illustrating the printer of the first embodiment in which the cover is in the open position.

The operation of the printer will be described. FIG. 8 is a sectional view illustrating the printer 1 of the first embodiment in which the rolled paper having the maximum diameter is housed in the second housing 32. FIG. 9 is a sectional view illustrating the printer 1 of the first embodiment in which the rolled paper having a medium diameter is housed in the second housing 32. FIG. 10 is a sectional view illustrating the printer 1 of the first embodiment in which the rolled paper having a small diameter is housed in the second housing 32. FIG. 11 is a sectional view illustrating the printer 1 of the first embodiment in which the cover 20 is moving from the closed position E1 to the open position E2. FIG. 12 is a sectional view illustrating the printer 1 of the first embodiment in which the cover 20 is in the open position E2. Hereinafter, the operation of the printer 1 of the first embodiment will be described. In addition, the vertically put printer 1 will be described hereinafter.

As illustrated in FIG. 8, in the vertically put printer 1, when the cover 20 is in the closed position E1 and the rolled paper R having the maximum diameter is housed in the second housing 32, the holding portion 42 is pressed by the outer circumference surface of the rolled paper R, and is moved in front of the third face 23*c* against the biasing force of the biasing member 43 in the first direction F. In this case, the holding portion 42 biases the rolled paper R in the first direction F.

As illustrated in FIG. 9, in the vertically put printer 1, when the cover 20 is in the closed position E1 and the rolled paper R having a medium diameter smaller than the maximum diameter is housed in the second housing 32, the holding portion 42 is pressed by the outer circumference surface of the rolled paper R, and is substantially moved between the first face 23*a* and the third face 23*c* against the biasing force of the biasing member 43 in the first direction F. In this case, the holding portion 42 biases the rolled paper R in the first direction F.

As illustrated in FIG. 10, in the vertically put printer 1, when the cover 20 is in the closed position E1 and the rolled paper R having a small diameter smaller than the middle diameter is housed in the second housing 32, the projection 42*c* of the holding portion 42 contacts the first face 23*a* to stop the rotation of the holding portion 42 in the first direction F. In this case, the holding portion 42 separates from the outer circumference surface of the rolled paper R.

More specifically, when the cover 20 is in the closed position E1, the holding portion 42 rotates in the first direction F in accordance with the outer diameter of the rolled paper R by the biasing force of the biasing member 43.

As illustrated in FIG. 11, in the vertically put printer 1, when the cover 20 is moved from the closed position E1 to the open position E2, the projection 42*c* of the holding portion 42 contacts the first face 23*a* to stop the rotation of the holding portion 42 in the first direction F. More specifically, in the vertically put printer 1, when the cover 20 rotates from the closed position E1 to the open position E2, the holding portion 42 rotates together with the cover 20 against the biasing force of the biasing member 43.

As illustrated in FIG. 12, in the vertically put printer 1, when the cover 20 is in the open position E2, the projection 42*c* of the holding portion 42 contacts the first face 23*a* to stop the rotation of the holding portion 42 in the first direction F.

The operation of the printer 1 of the first embodiment will be described. The printer 1 of the first embodiment includes the case 10 having the input port G from which the rolled paper R is put into the housing (first housing 31, second housing 32) that houses the rolled paper R, the cover 20 provided to be rotatable between the closed position E1 that closes the input port G and the open position E2 that opens the input port G, the holding portion 42 that is rotatably attached to the case 10, extends toward the input port G, and holds the rolled paper R, the biasing member 43 that biases the holding portion 42 in the first direction F toward the rolled paper R housed in the housing (first housing 31, second housing 32), the stopper mechanism (first face 23*a*, projection 42*c*) that stops the rotation of the holding portion 42 in the first direction F, and the linkage mechanism (first face 23*a*, projection 42*c*) that rotates the holding portion 42 in conjunction with the rotation of the cover 20 when the cover 20 rotates from the closed position E1 to the open position E2. When the cover 20 is in the closed position E1, the holding portion 42 rotates in the first direction F in accordance with the outer diameter of the rolled paper R by the biasing force of the biasing member 43, and when the cover 20 rotates from the closed position E1 to the open position E2, the holding portion 42 rotates together with the cover 20 against the biasing force of the biasing member 43 (FIG. 8).

Accordingly, when the cover 20 is in the closed position E1, the holding portion 42 rotates in accordance with the size of the rolled paper R to bias the rolled paper R in the first direction F. Thus, the holding portion 42 holds the rolled paper R regardless of the size of the rolled paper R. In particular, when the sheet S is fed from the rolled paper R, the loosening of the rolled paper R due to a difference in a friction force between the inside face of the sheet S that contacts the paper face of the rolled paper R and the outside face of the sheet S that contacts the housing (first housing 31, second housing 32) can be restrained. When the sheet S is fed from the rolled paper R, the fluttering of the rolled paper R due to the inertia acting when the sheet S is fed can be also restrained.

When the cover 20 rotates from the closed position E1 to the open position E2, the holding portion 42 rotates together with the cover 20. Accordingly, even when the holding portion 42 is provided to close the input port G of the rolled paper R, it is not necessary to remove the holding portion 42 away by hand when the rolled paper R is taken out from the housing (first housing 31, second housing 32) or the rolled paper R having the maximum diameter is put in the housing (first housing 31, second housing 32).

More specifically, the holding portion 42 does not disturb the putting of the rolled paper R while holding the rolled paper R by biasing the rolled paper R from the input port G side. As a result, the printer 1 in which the housed rolled paper R is maintained in a desired position and the rolled paper R is easily exchanged can be provided.

In the printer 1 of the first embodiment, the linkage mechanism (first face 23*a*, projection 42*c*) is a mechanism that moves the engaged cover 20 and holding portion 42 together (FIGS. 8 to 12).

With this, the holding portion 42 rotates in conjunction with the rotation of the cover 20 with a simple configuration when the cover 20 rotates from the closed position E1 to the open position E2.

In the printer 1 of the first printer, the stopper mechanism is provided in the cover 20 and the holding portion 42. The stopper mechanism (first face 23*a*, projection 42*c*) controls the rotation of the holding portion 42 in the first direction F within a predetermined rotation range, and moves the engaged cover 20 and holding portion 42 together when the cover 20 rotates from the closed position E1 to the open position E2 (FIGS. 8 to 12).

With this, the holding portion 42 stops from rotating in the first direction F with a simple configuration.

The printer 1 of the first embodiment incudes the first housing 31 that houses the rolled paper R when the case 10 is put in a horizontal posture such that the cover 20 is the top face, and the second housing 32 formed together with the holding portion 42 in which the rolled paper R is housed when the case 10 is put in a vertical posture such that the cover 20 is the side face. The position where the rolled paper R having the maximum diameter is housed in the first housing 31 in the horizontal posture and the position where the rolled paper R having the maximum diameter is housed in the second housing 32 in the vertical posture are substantially the same (FIGS. 3 and 8).

With this, the position where the rolled paper R having the maximum diameter is housed in the vertical posture can be the same as the position where the rolled paper R having the maximum diameter is housed in the horizontal posture. Thus, the size of the housing (first housing 31, second housing 32) can be reduced as much as possible. As a result, the printer 1 is downsized.

In the printer 1 of the first embodiment, each of the first housing 31 and the second housing 32 has a sectional V shape (FIG. 3).

With this, the rolled paper R can be supported by the V shape in the both vertical posture and horizontal posture. Accordingly, the rolled paper R can be housed by controlling the movement of the rolled paper R in the rotation axis orthogonal direction. As a result, the housed rolled paper R can be maintained in a desired position, and thus, the detection accuracy of the rolled paper remaining detection sensor 50 can be improved.

In the vertical posture, the second housing 32 formed into the V shape together with the holding portion 42 can reduce the angle of the V shape in accordance with a decrease in a diameter of the rolled paper R. The rolled paper R having a small diameter can be therefore prevented from moving up the V-shaped second housing 32. As a result, the detection accuracy of the rolled paper remaining detection sensor 50 can be improved.

The printer 1 of the first embodiment includes the rolled paper remaining detection sensor 50 that is provided in the side wall face of the case 10, and detects the remaining of the rolled paper R based on the reflection light from the side face of the rolled paper R. The rolled paper remaining detection sensor 50 is disposed in the region Q (FIG. 3) surrounded by the center axis RP of the rolled paper R having the maximum diameter, which is housed in the first housing 31 or the second housing 32, the first apex 31P that is the apex of the sectional V shape of the first housing 31, and the second apex 32P that is the apex of the sectional V shape of the second housing 32.

With this, the rolled paper remaining detection sensor 50 can be commonly used in both vertical posture and horizontal posture. Accordingly, it is not necessary for the vertical posture and the horizontal posture to provide a separate rolled paper remaining detection sensor. As a result, the component costs can be reduced.

In the printer 1 of the first embodiment, the rolled paper remaining detection sensor 50 is configured to be movable in a circular arc in accordance with the outer diameter of the rolled paper R having the maximum diameter, which is housed in the first housing 31 or the second housing 32 (FIG. 3).

With this, the rolled paper remaining detection sensor 50 can be moved in accordance with the diameter of the rolled paper R housed in the first housing 31 or the second housing 32. Accordingly, the common rolled paper remaining detection sensor 50 can be used in the both vertical posture and horizontal posture, and the position of the rolled paper remaining detection sensor 50 can be adjusted in accordance with the diameter of the vertically put rolled paper R and the diameter of the horizontally put rolled paper R.

In the printer 1 of the first embodiment, the sheet S of the rolled paper R is fed from the side opposite to the side provided with the holding portion 42 (FIG. 3).

With this, when the sheet S is fed from the rolled paper R, the holding portion 42 can bias the rolled paper R by being pulled with the sheet S to be fed to face in the direction in which the rolled paper R moves. Accordingly, when the sheet S is fed from the rolled paper R, the rolled paper R can be restrained from fluttering due to the inertia acting when the sheet S is fed. As a result, the housed rolled paper R can be maintained in a desired position.

Even when the printer 1 is horizontally put, the holding portion 42 biases the rolled paper R from the slightly rear side of the upper side, which contributes to the stable supplying of the sheet S from the rolled paper R.

As described above, the printer of the present disclosure is described based on the first embodiment, the specific configuration is not limited to the embodiment. The embodiment may be modified and/or changed without departing from the spirit of the present disclosure.

In the first embodiment, the example in which the rolled paper remaining detection sensor 50 is configured to be movable in the circular arc is illustrated. However, the rolled paper remaining detection sensor may be configured to be movable straight.

In the first embodiment, the example in which the sheet S is fed from the rolled paper R housed in the first housing 31 and the second housing 32 on the side opposite to the side provided with the holding portion 42. However, the sheet may be fed from the rolled paper on the side provided with the holding portion 42.

The first embodiment shows the example in which the printer 1 includes the first housing 31 that houses the rolled paper R in the horizontal posture and the second housing 32 that houses the rolled paper R in the vertical posture. However, the printer may include at least one of the first housing or the second housing.

The first embodiment shows the example in which the opening portion 23 is provided in the rib 22 attached to the cover 20 and the projection 42*c* is provided in the holding portion 42, such that these are engaged. However, a portion or a component corresponding to the opening portion 23 may be provided in the holding portion 42 and a portion or a component corresponding to the projection 42*c* may be provided in the cover 20 to configure the linkage mechanism with these.

The first embodiment shows the example in which the first face 23*a* of the opening portion 23 in the rib 22 attached to the cover 20 is configured as the stopper that stops the movement of the projection 42*c* in the first direction F in a predetermined rotation position. However, the stopper may be provided separately from the cover 20. For example, when a portion or a component corresponding to the opening portion 23 is provided in the case 10, the projection that contacts the stopper provided in the case 10 may be provided in the holding portion 42 in addition to the projection 42*c* provided in the holding portion 42, and the stopper mechanism may be configured by the portion or the component corresponding to the opening portion 23 and the projection that contacts the stopper.

The first embodiment shows the example in which the printer of the present disclosure is applied to a thermal printer that prints on thermal paper. However, the printer of the present disclosure is not limited to the thermal printer, and may be applied to a printer having a housing that houses the rolled paper.

The above are only some embodiments of the present disclosure and are not intended to limit the present disclosure. For those skilled in the art, the present disclosure may have various modifications and variations. Any modifications, equivalent substitutions, improvements and the like made within the spirit and principle of the present disclosure should fall within the protection scope of the present disclosure.

What is claimed is:

1. A printer comprising:

a case comprising an input port from which a rolled paper is put into a housing that houses the rolled paper;

a cover provided to be rotatable between a closed position that closes the input port and an open position that opens the input port;

a holding portion that is rotatably attached to the case, extends toward the input port, and holds the rolled paper;

a biasing member that biases the holding portion in a first direction toward the rolled paper housed in the housing;

a stopper mechanism provided in the cover and the holding portion that stops rotation of the holding portion in the first direction; and a linkage mechanism that rotates the holding portion in conjunction with the rotation of the cover when the cover rotates from the closed position to the open position, wherein, when the cover is in the closed position, the holding portion rotates in the first direction in accordance with an outer diameter of the rolled paper by a biasing force of the biasing member, wherein, when the cover rotates from the closed position to the open position, the holding portion rotates together with the cover against the biasing force of the biasing member, wherein the stopper mechanism controls the rotation of the holding portion in the first direction within a predetermined rotation range, and moves the cover and the holding portion together when the cover rotates from the closed position to the open position.

2. The printer according to claim 1, wherein the linkage mechanism moves the cover and holding portion together.

3. The printer according to claim 1, wherein the housing comprises:

a first housing that houses the rolled paper when the case is put in a horizontal posture, and a second housing that and houses the rolled paper when the case is put in a vertical posture, wherein a position which holds the rolled paper having a maximum diameter in the case is substantially the same when the rolled paper having the maximum diameter is housed in the first housing of the case in the horizontal posture and when the rolled paper having the maximum diameter is housed in the second housing of the case in the vertical posture.

4. The printer according to claim 3, wherein each of the first housing and the second housing has a sectional V shape.

5. The printer according to claim 4, wherein the case comprises a rolled paper remaining detection sensor that detects remaining of the rolled paper based on reflection light from a side face of the rolled paper, and wherein the rolled paper remaining detection sensor is disposed in a region surrounded by a center axis of the rolled paper having the maximum diameter housed in the first housing or the second housing, a first apex that is an apex of the sectional V shape of the first housing, and a second apex that is an apex of the sectional V shape of the second housing in a side view.

6. The printer according to claim 5, wherein the rolled paper remaining detection sensor is movable in a circular arc along an outer diameter of the rolled paper having the maximum diameter, which is housed in the first housing or the second housing.

7. The printer according to claim 1, wherein a sheet of the rolled paper is fed from a side opposite to the side provided with the holding portion.

* * * * *